US006907762B2

(12) United States Patent
Massee

(10) Patent No.: US 6,907,762 B2
(45) Date of Patent: Jun. 21, 2005

(54) METHOD AND FORMING MACHINE FOR DEFORMING A HOLLOW WORKPIECE

(76) Inventor: Johan Massee, Viifeprongweg 104, 6741 Lunteren (NL)

( * ) Notice: Subject to any disclaimer, the term of this patent is extended or adjusted under 35 U.S.C. 154(b) by 0 days.

(21) Appl. No.: 10/333,502

(22) PCT Filed: Jul. 20, 2001

(86) PCT No.: PCT/NL01/00564

§ 371 (c)(1),
(2), (4) Date: Jan. 20, 2003

(87) PCT Pub. No.: WO02/07907

PCT Pub. Date: Jan. 31, 2002

(65) Prior Publication Data

US 2003/0172702 A1 Sep. 18, 2003

(30) Foreign Application Priority Data

Jul. 21, 2000 (NL) ..... 1015773
Oct. 6, 2000 (NL) ..... 1016348

(51) Int. Cl.[7] ..... B21B 1/10

(52) U.S. Cl. ..... 72/101; 72/84; 72/86; 72/111; 72/120

(58) Field of Search ..... 72/82, 84, 86, 72/94, 95, 101, 110, 111, 119, 120, 121, 124, 125

(56) References Cited

U.S. PATENT DOCUMENTS

| | | | | |
|---|---|---|---|---|
| 1,297,819 A | | 3/1919 | Ferrier | |
| 1,500,261 A | | 7/1924 | Page | |
| 2,358,307 A | | 9/1944 | Dewey | 80/13 |
| 3,055,414 A | | 9/1962 | Boldrini | 153/54 |
| 3,299,680 A | | 1/1967 | Thompson | 72/6 |
| 3,533,259 A | | 2/1967 | Marcovitch | 72/110 |
| 3,340,713 A | | 9/1967 | Webb | 72/83 |
| 3,380,275 A | * | 4/1968 | McGraw, Jr. | 72/121 |
| 3,851,515 A | | 12/1974 | Hautau | 72/121 |
| 3,874,209 A | * | 4/1975 | Maiorino | 72/91 |

(Continued)

FOREIGN PATENT DOCUMENTS

| | | |
|---|---|---|
| DE | 1024046 | 2/1958 |
| DE | 4218092 C1 | 6/1993 |
| EP | 0125720 | 11/1984 |
| EP | 0 916 426 A1 | 5/1999 |
| EP | 0 916 428 A2 | 5/1999 |

(Continued)

OTHER PUBLICATIONS

Application Ser. No. 10/333,503, filed Jan. 20, 2003.
Application Ser. No. 10/333,505, filed Jan. 20, 2003.
EPO Opposition Communications for 0916428.
EPO Opposition Communications for 0916426.

*Primary Examiner*—Ed Tolan
(74) *Attorney, Agent, or Firm*—Westman, Champlin & Kelly, P.A.; Steven A. Koehler

(57) ABSTRACT

The invention relates to a method and a forming apparatus for deforming a hollow tubular workpiece, wherein the workpiece is clamped down in a clamping device, a first forming tool is placed into contact with the outer surface of the workpiece, the tool is rotated about an axis of rotation relative to the workpiece and one end of the workpiece is deformed by means of said first tool. A second forming tool is placed into contact with the outer surface of the workpiece and is rotated relative to the workpiece about an axis of rotation. The other end of the workpiece is deformed by means of said second tool and at least one of said tools is moved relative to the workpiece during said deformation and/or between deforming steps (On the same workpiece), wherein the axis of rotation of said tool is translated and/or pivoted about an axis with respect to said workpiece.

12 Claims, 4 Drawing Sheets

U.S. PATENT DOCUMENTS

| | | | | | |
|---|---|---|---|---|---|
| 4,061,009 | A | | 12/1977 | Kaporovich et al. | 72/69 |
| 4,091,648 | A | | 5/1978 | McCaslin | 72/121 |
| 4,143,535 | A | | 3/1979 | Bouman | 72/119 |
| 4,297,926 | A | | 11/1981 | Russ et al. | 82/9 |
| 4,445,352 | A | | 4/1984 | Pols | 72/101 |
| 4,563,887 | A | | 1/1986 | Bressan et al. | 72/84 |
| 4,838,064 | A | * | 6/1989 | Pass | 72/84 |
| 5,372,028 | A | | 12/1994 | Brilman et al. | 72/117 |
| 5,408,906 | A | | 4/1995 | Gleason | 82/106 |
| 5,419,223 | A | | 5/1995 | Kubler et al. | 82/118 |
| 5,570,603 | A | | 11/1996 | Chatterley et al. | 72/101 |
| 5,571,541 | A | * | 11/1996 | Ochsenbein et al. | 425/393 |
| 5,596,897 | A | | 1/1997 | Payne | 72/84 |
| 5,758,532 | A | | 6/1998 | Massee | 72/83 |
| 5,827,161 | A | | 10/1998 | Petit | 493/102 |
| 5,901,595 | A | | 5/1999 | Massee | 72/81 |
| 5,937,516 | A | | 8/1999 | De Sousa et al. | 29/890 |
| 5,996,386 | A | | 12/1999 | Pazzaglia | 72/84 |
| 6,018,972 | A | | 2/2000 | Irie | 72/121 |
| 6,055,836 | A | | 5/2000 | Waterworth et al. | 72/110 |
| 6,067,833 | A | | 5/2000 | Irie | 72/121 |
| 6,216,512 | B1 | | 4/2001 | Irie | 72/121 |
| 6,233,993 | B1 | * | 5/2001 | Irie | 72/121 |
| 6,386,010 | B1 | | 5/2002 | Irie et al. | 72/84 |

FOREIGN PATENT DOCUMENTS

| | | |
|---|---|---|
| FR | 1004843 | 3/1952 |
| JP | 60261608 | 12/1985 |
| JP | 62-167956 | 7/1987 |
| JP | 4115803 | 4/1992 |
| JP | 10076401 | 3/1998 |
| JP | 10151501 | 6/1998 |
| PL | 157062 B | 4/1992 |
| WO | WO 02/062500 | 8/2002 |

* cited by examiner

METHOD AND FORMING MACHINE FOR DEFORMING A HOLLOW WORKPIECE

CROSS-REFERENCE TO RELATED APPLICATION

The present application is a national stage filing and claims priority of International patent application Serial No. PCT/NL01/00564, filed Jul. 20, 2001, and published in English the content of which is hereby incorporated by reference in its entirety.

BACKGROUND OF THE INVENTION

The invention relates to a method for deforming a hollow tubular workpiece, wherein the workpiece is clamped down in a clamping device, a first forming tool is placed into contact with the outer surface of the workpiece, said tool is rotated about an axis of rotation relative to the workpiece and one end of the workpiece is deformed by means of said first tool. The invention furthermore relates to a forming machine in accordance with the preamble of claim 7.

Such a method and forming machine are known, for example from European patent application No. EP 0 916 428. Said publication discloses a method and a forming machine, comprising a forming head fitted with a number of rollers, by means of which the diameter of one end of a cylindrical metal element is reduced and moreover bent through an angle.

To this end, the metal cylinder is clamped down and said cylinder and said forming head are rotated relative to each other about an axis of rotation, whereupon said end is deformed by pressing said rollers in radial direction against the outer surface of said cylinder and moving them along said outer surface in a number of cycles, whereby the radial distance between the rollers and the axis of rotation is decreased with each cycle, as a result of which a reduction of the diameter is obtained. Since the axis of rotation is at an angle with the central axis of the metal cylinder, the end of the cylinder is not only reduced as a result of the movement in radial direction of the rollers, but in addition said end will also be positioned at an angle. Due to the use of the aforesaid cycles, the workpiece assumes the shape of the final product step by step.

EP 0 916 426 discloses a comparable method and forming machine, wherein the axis of rotation is eccentrically offset from the central axis of the metal cylinder. Thus a product is obtained wherein the central axis of the deformed portion is likewise offset from the central axis of the undeformed portion of the metal cylinder.

The method and forming machine in hand can be used, for example, in the production of the housings of catalytic converters that form part of the exhaust system of vehicles, such as passenger cars. Such catalytic converters have a diameter which is larger than the diameter of the pipes of the exhaust system of which they form part, and they are preferably positioned close to the engine block in order to reach their operating temperature as quickly as possible after the engine has been started and to maintain that temperature as much as possible. One consequence of this is that, first of all, the diameter of the connections on either side of the catalytic converter housing must be reduced in order to properly connect to the rest of the exhaust system and that in addition they often need to have a complicated shape in order to enable an optimum position with respect to the engine block.

When using the prior art methods and apparatuses for producing workpieces having two deformed ends, such as e.g. the above-described catalytic converter housings the clamped-down workpiece must be detached after one end has been worked and be clamped down anew for working the other end.

SUMMARY OF THE INVENTION

It is an object of the present invention to eliminate this drawback. In order to accomplish that objective, the method as referred to in the first paragraph is characterized in that a second forming tool is placed into contact with the outer surface of the workpiece and is rotated relative to the workpiece about an axis of rotation, that the other end of the workpiece is deformed by means of the second tool and that at least one of said tools is moved relative to the workpiece during said deformation and/or between deforming steps (on the same workpiece), wherein the axis of rotation of said tool is translated and/or pivoted about an axis with respect to said workpiece.

The above aspects make it possible to work both ends of a tubular workpiece simultaneously without having to detach the workpiece between operations and clamp it down again. Moreover, the two ends can be given complex, asymmetric and mutually different shapes.

More complex shapes can be obtained by pivoting the tools relative to the workpiece about at least one axis during said deformation and/or between deforming steps (on the same workpiece). Pivoting about two or more axes, wherein at least two of said axes, or the projections of each of said axes on a common plane, are at an angle (for example of 90°) with respect to each other, makes it possible to produce complex shapes in various directions.

It is preferred that at least one inside forming tool is placed into the cavity defined by the workpiece, at the location of at least one of the ends thereof, into contact with the inner surface of the hollow workpiece, and the workpiece is deformed by means of said second tool. This provides greater freedom as regards design and makes it possible to deform the workpiece in such a manner that the deformed portions extend outside the diameter of the original workpiece, which is not possible with the method and apparatus according to the above described prior art. If the workpiece is a metal cylinder, this means that after deformation, the deformed end(s) will lie partially or entirely outside the circumference of the undeformed part of the metal cylinder.

Moreover, the load that is exerted on the workpiece during the deformation process can be considerably reduced, so that it will be possible to form workpieces having a relatively small wall thickness as well. A minimum wall thickness of the cylindrical starting material of 1.5 mm is frequently used for the aforesaid housings for catalytic converters, whilst the invention makes it possible to deform materials having a smaller wall thickness of, for example, 1.2 mm or less.

The invention furthermore relates to a hollow tubular workpiece having a continuous wall and two open ends, which have been deformed in such a manner that the projections of said ends on a plane straight through an undeformed part of the metal workpiece are at an angle of less than 180° with each other, as well as to a catalytic converter for a vehicle, such as e.g. a car, comprising such a workpiece.

BRIEF DESCRIPTION OF THE DRAWINGS

The invention will now be explained in more detail with reference to the appended figures, which show an embodiment of the method and the forming machine according to the present invention.

DETAILED DESCRIPTION OF ILLLUSTRATIVE EMBODIMENTS

Parts corresponding to each other or having substantially the same function will be indicated by the same numerals in the various figures.

Figure 1:
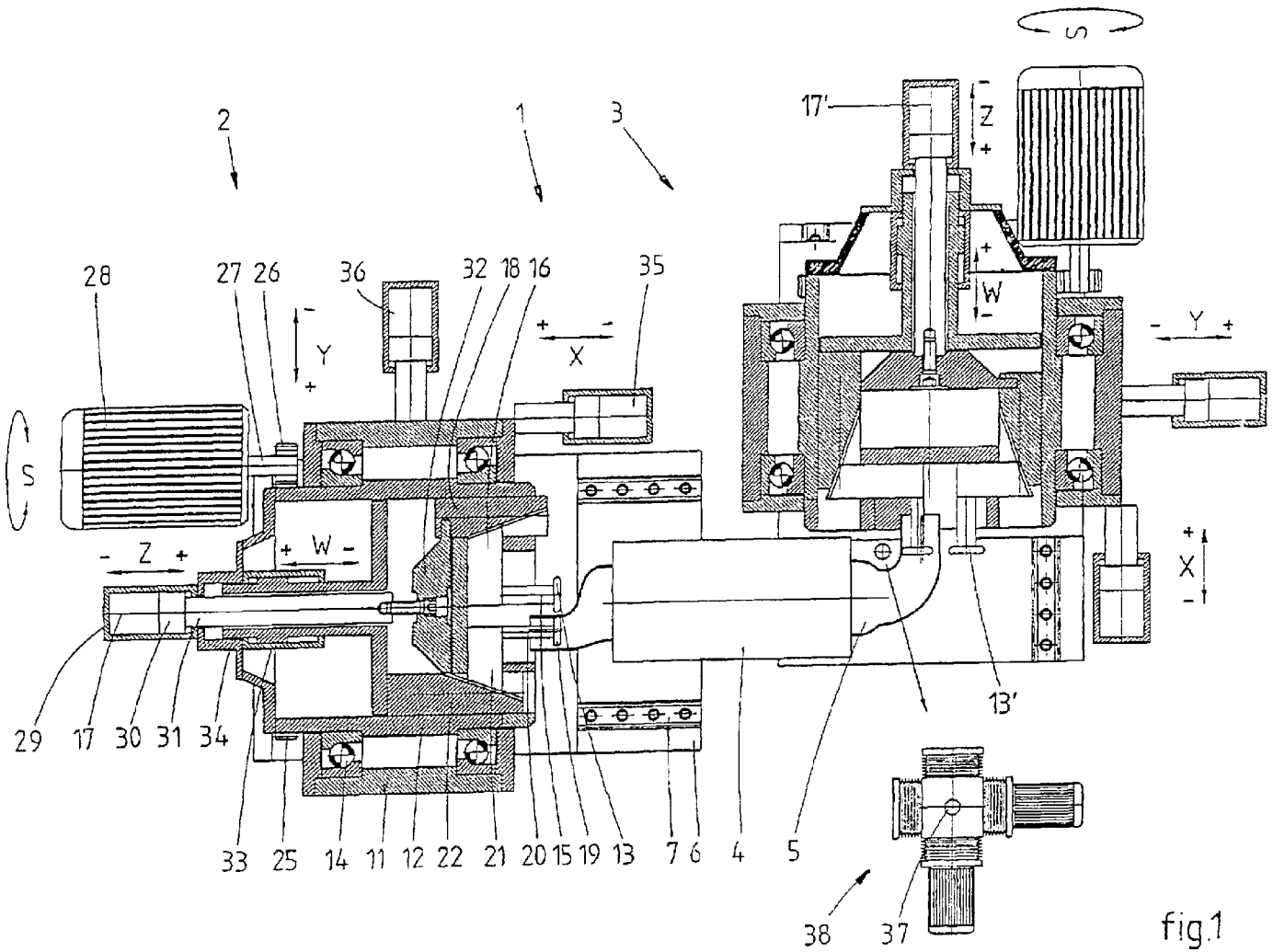
FIG. 1 is a schematic top plan view, partially in section, of a forming machine according to the present invention, comprising two forming heads.

FIG. 1 shows a forming machine 1 comprising a first forming head 2, a second forming head 3 and a chuck 4 for clamping down the workpiece, for example the illustrated, already deformed, metal cylinder 5. The two forming heads 2,3 comprise a baseplate 6 on which two guide rails 7 are mounted. Guides 8 extend over said rails 7 on which guides a second set of guide rails 9 is mounted, which extend at right angles to said first rails 7. Present on said second set of rails are guides 10, which support a housing 11, in which an assembly 12, comprising forming rollers 13 and means for moving said forming rollers 13, is mounted in bearings 14.

Each of the forming rollers 13 is rotatably mounted on one end of a rod 15, which is in turn mounted on or forms part of a wedge-shaped element 16, which widens in the direction of forming rollers 13. Forming rollers 13 and their respective rods 15 and wedge-shaped elements 16 can each be moved radially inwards and outwards relative to the axis of rotation 17 of assembly 12. To this end, each of the wedge-shaped elements 16 is mounted on a wedge-shaped guiding mandrel 18, whose thickness decreases linearly in the direction of forming rollers 13, in such a manner that wedge-shaped elements 16, and thus rods 15 and rollers 13, are forced radially towards axis of rotation 17 upon outward movement (to the right in the drawing) of mandrels 18, and radially away from axis of rotation 17 upon inward movement (to the left in the drawing) thereof.

In accordance with the invention, assembly 12 furthermore comprises a forming roller 19 (hereinafter called inside roller 19), which is mounted in assembly 13 in substantially the same manner as forming rollers 13, i.e. rotatably mounted on one end of a rod 20, which is in turn mounted on or forms part of a wedge-shaped element 21, which widens in the direction of forming inside roller 19. Element 21 is mounted on a wedge-shaped mandrel 22, in such a manner that element 21, and thus rod 20 and roller 19 are forced radially towards axis of rotation 17 upon outward movement of mandrel 22 and radially away from axis of rotation 17 upon inward movement thereof.

In FIG. 1, inside roller 19 has been moved into workpiece 5 and has been placed into contact with the inner wall of workpiece 5. The wall of workpiece 5 can be deformed in outward direction, that is, in radial direction away from the cavity 5 defined by workpiece 5, by means of said inside roller 19. Forming rollers 13 and inside roller 19 often lie in the same plane, which plane extends perpendicularly to axis of rotation 17 in this embodiment, so that the wall is confined between said rollers 13, 19 at the location of the deformation.

Assembly 12 comprises an external gear 25 on a side remote from rollers 13, 19, which gear mates with a pinion 26 mounted on the end of a drive shaft 27 of an electric motor 28.

Thus, the assembly 12 can be rotated by means of electric motor 28.

Assembly 12 furthermore comprises a hydraulic cylinder 29, which is capable of moving ring 18, and thus forming rollers 13, in radial direction by means of a piston 30, a piston rod 31 and a pressure plate 32. Within the framework of the present description, the radial movement of the forming rollers 13 will be indicated as the Z-direction.

Ring 22, and thus inside roller 19, can be moved in radial direction by means of a hydraulic cylinder 33 and a hollow piston rod 34, whilst housing 11 can be moved along said guide rails 7 and 9 in its entirety by means of hydraulic cylinders 35 and 36. Within the framework of the present description, the radial movement of inside roller 19 will be indicated as the W-direction. Movements of housing 11 parallel to axis of rotation 17 and perpendicularly to said axis 17 will be indicated as the X-direction and the Y-direction, respectively.

Second forming head 3 is practically identical to forming head 2, but it is furthermore capable of pivoting movement about a pivot point 37, so that the end of workpiece 5 that is being worked by said forming head 3 can be deformed through an angle of 90°, for example. In addition, an assembly 38 is provided, by means of which axis 37 can be moved, as will be explained in more detail hereafter.

Figure 4:
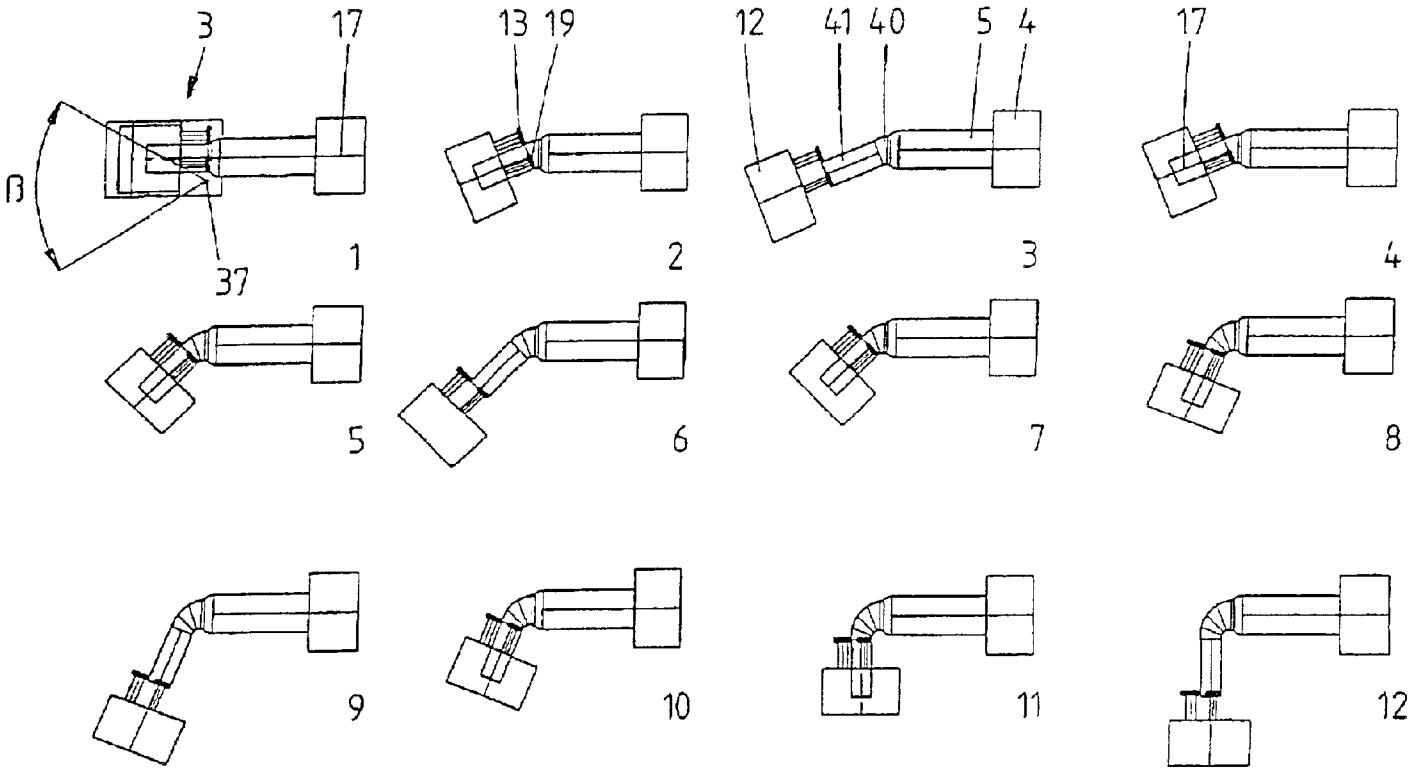
FIGS. 4 and 5 schematically show a number of stages of a method according to the present invention, carried out on the forming machine of FIG. 1.
Figure 5:
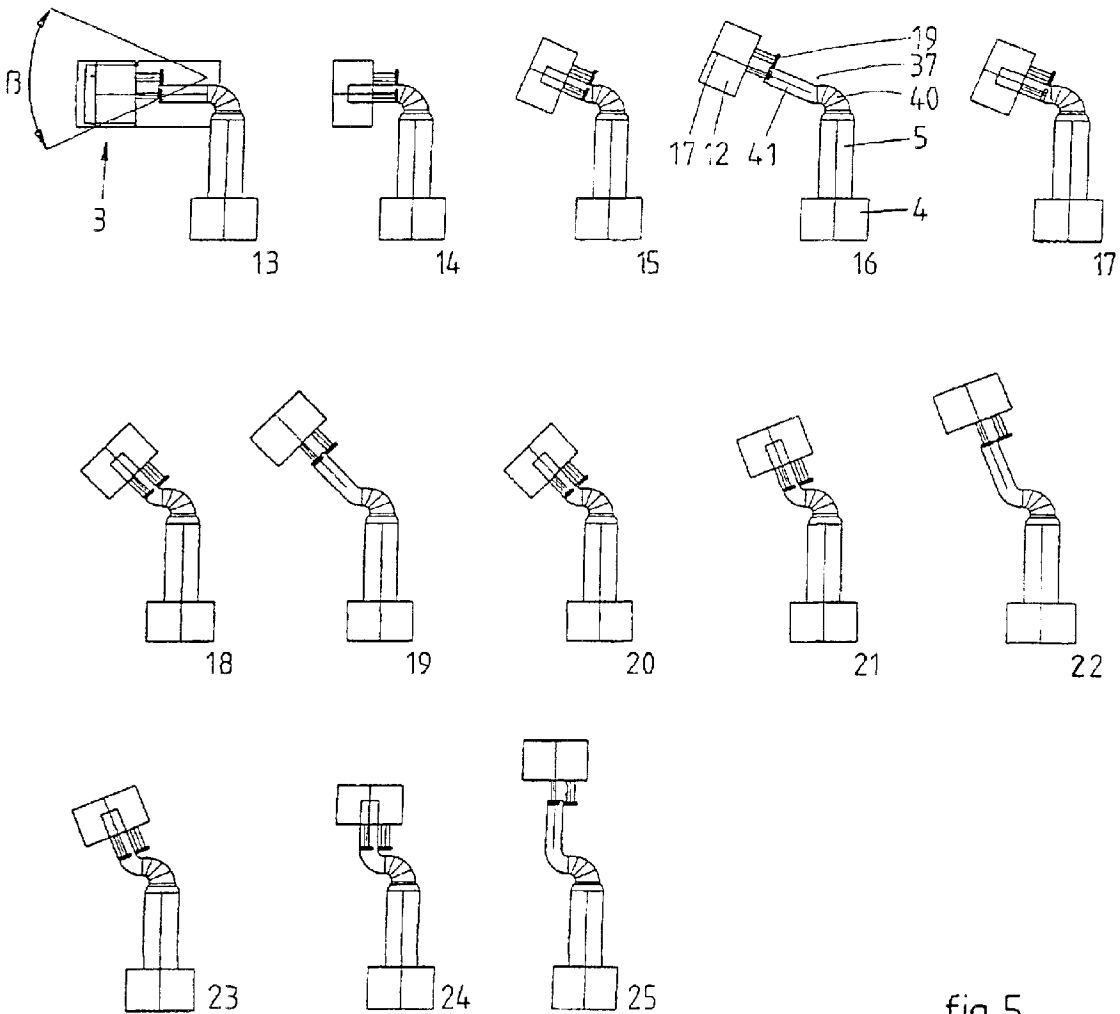

FIGS. 4 and 5 schematically show in 25 steps the manner in which an open end of a metal cylinder 5 can be deformed by means of forming head 3 of forming machine 1 according to FIG. 1.

At the same time, the other end of cylinder 5 can be worked by means of forming head 2. Step 1 shows the starting position, wherein workpiece 5 is clamped down in a chuck 4. Said end, which has already undergone a machining step and which has a smaller diameter than the other part of cylinder 5, is then (step 2) deformed by rotating assembly 12 and placing the forming rollers 13, 19 into contact with, respectively, the outer surface and the inner surface of cylinder 5 and moving said rollers radially towards axis of rotation 17 and away from axis of rotation 17, respectively, and simultaneously pivoting the forming head through an angle β about pivot point 37. The various driving means are thereby controlled in such a manner that a composite, flowing movement of the forming rollers 13, 19 (in Z-direction and W-direction), assembly 13 (in X-direction and Y-direction) and the forming head (through an angle β) is obtained, as a result of which a bent portion 40 is formed.

After forming head 3 has been pivoted through an angle β, the movement of the assembly 12 in the X-direction is continued (step 3), so that a cylindrical portion 41 remains, which portion has a smaller diameter than the original open end of cylinder 5 and which extends at an angle β relative to the other part of cylinder 5.

Then (step 4) the forming rollers 13, 19 are moved radially outwards and radially inwards, respectively, so that the contact between said rollers 13, 19 and, respectively, the outer surface and the inner surface of the wall of cylinder 5 is broken. Assembly 12 is moved back along cylindrical portion 41 in the X-direction and the Y-direction until the transition between the bent portion 40 and said cylindrical portion 41.

The above cycle is repeated by pivoting forming head 3 through an angle β and translating and adjusting assembly 12 (step 5, which is substantially identical to step 2) and translating assembly 12 in the X-direction and the Y-direction (step 6, which is substantially identical to step 3), wherein the diameter of the cylindrical portion 41 is further reduced.

Then the contact between said rollers and said cylindrical portion 41 is broken, and the assembly is returned to the transition area between bent portion 40 and cylindrical portion 41 (step 7, which is substantially identical to step 4).

Depending on the characteristics of the workpiece, such as the wall thickness, the mechanical strength and stiffness and the elastic elongation, steps 2–4 are repeated until the desired reduction of the diameter and the desired angle, for example of 90, have been obtained. If the nature of the workpiece involves that the angle β must not be larger than, for example, 15 or 8 per cycle, a total number of, respectively, 6 and 12 cycles will be required for the said deformation.

After the operations that are shown in FIG. 4 have been carried out, pivot point 37 is moved by means of assembly 38 to the starting position as shown in FIG. 5 (step 13). The operation of FIG. 4 (steps 2–12) are repeated (steps 14–25), wherein the angle β is of opposite sense, however, so that an S-bend is obtained in the end of cylinder 5.

Figure 3:
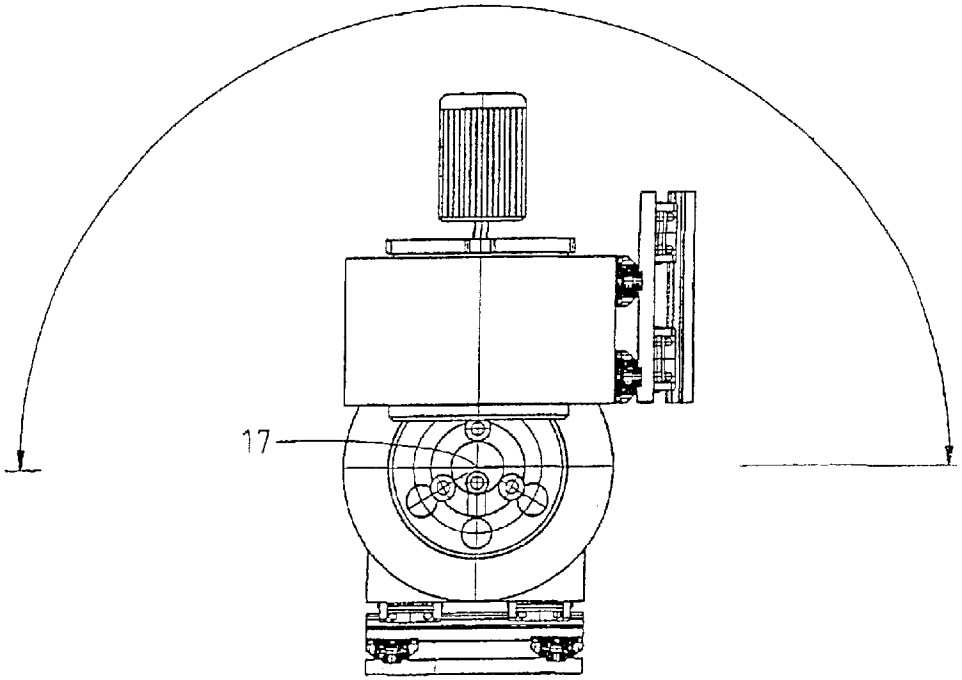
FIG. 3 is a side elevation of the forming machine of FIG. 1, wherein a part of the forming machine is turned through an angle of 90°.
Figure 2:
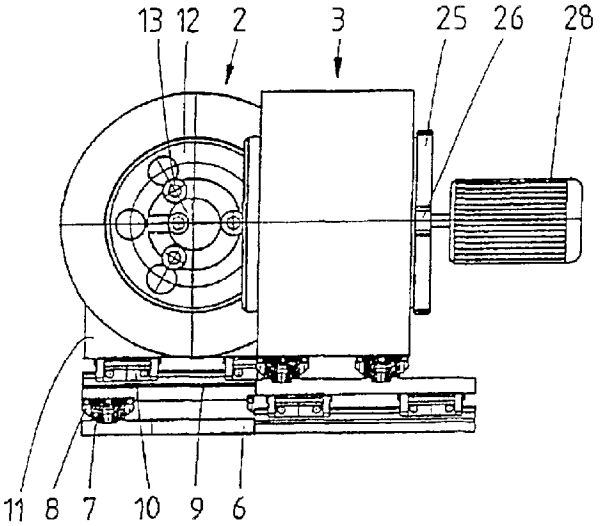
FIG. 2 is a side elevation of the forming machine of FIG. 1.

As is shown in FIG. 3, the forming head 3 of forming machine 1 is furthermore capable of pivoting movement about axis of rotation 17 of forming head 2, so that the bending of workpiece 5 is not limited to bending in one and the same imaginary plane. Pivoting of forming head 3 about axis of rotation 17 between or during operations enables the central axis of the deformed portion of workpiece 5 to assume a three-dimensional shape.

As a matter of course the forming machines according to the present invention can be operated by a person as well as by a control unit. Such a control unit is for example arranged for controlling the means for moving the rollers in X-direction, Y-direction and radial direction in accordance with a control program that is stored in a memory, in such a manner that the forming rollers follow one or more desired paths for deforming the workpiece into the desired product or intermediate product.

Consequently, the invention is not restricted to the above-described embodiments, which can be varied in several ways without departing from the scope of the invention as defined in the claims. Thus it is also possible, of course, to implement the invention on workpieces of unround section, such as e.g. an oval, a substantially triangular or a multilobal section.

What is claimed is:

1. A method for deforming a hollow tubular workpiece, wherein the workpiece is clamped down in a clamping device, a first forming tool is placed into contact with the outer surface of the workpiece, said first forming tool is rotated about an axis of rotation relative to the workpiece and one end of the workpiece is deformed by means of said first forming tool, wherein a second forming tool is placed into contact with the outer surface of the workpiece and is rotated relative to the workpiece about an axis of rotation such that the other end of the workpiece is deformed by means of the second forming tool and that at least one of said tools is moved relative to the workpiece during said deformation and/or between deforming steps on the same workpiece, wherein the axis of rotation of at least one of said tools is translated and/or pivoted about an axis with respect to said workpiece.

2. The method according to claim 1, wherein both tools are moved relative to the workpiece during said deformation and/or between deforming steps on the same workpiece, wherein the axes of rotation of said tools are translated and/or pivoted about an axis.

3. The method according to claim 1, wherein at least one of said tools is pivoted about at least two axes relative to the workpiece during said deformation and/or between deforming steps, wherein at least two of said axes, or projections of each of said axes on a common plane, are at an angle with respect to each other.

4. The method according of claim 1, wherein at least one of said axes is moved during said deformation and/or between deforming steps.

5. The method according to claim 1, wherein the larger part of the operation is carried out in one flowing movement.

6. The method according to claim 1, wherein at least one inside forming tool is placed into a cavity defined by the workpiece, at the location of at least one of the ends thereof, into contact with the inner surface of the hollow workpiece, and wherein the workpiece is deformed by means of said second forming tool.

7. The hollow tubular workpiece having a continuous wall and two open ends, which have been deformed, preferably by means of the method according claim 6, in such a manner that the projections of the central axes of said ends on a plane straight through an undeformed part of the metal workpiece are at an angle of less than 180 degrees with respect to each other.

8. A catalytic converter for a vehicle comprising a workpiece according to claim 7.

9. A forming machine at least comprising a clamping device for clamping down a hollow tubular workpiece to be deformed, a first forming tool, which is placeable into contact with the outer surface of the workpiece while the workpiece is being worked and by means of which one end of the workpiece is deformable, driving means for rotating said first forming tool relative to said workpiece and means for moving said first forming tool relative to said workpiece in such a manner that said first forming tool follows one or more desired paths with respect to the workpiece so as to work said workpiece, at least one second forming tool, which is placeable into, contact with the outer surface of the workpiece during the machining of the workpiece, and by means of which the other end of the workpiece is deformable, as well as driving means for rotating aid second forming tool relative to said workpiece and means for moving said second forming tool relative to said workpiece in such a manner that said second forming tool follows one or more desired paths with respect to the workpiece so as to work said workpiece, wherein at least one of said tools is movable relative to the workpiece during said deformation and/or between deforming steps (on the same workpiece) in such a manner that the axis of rotation of at least one of said tools is translated and/or pivoted about an axis relative to said workpiece.

10. The forming machine according to claim 9, wherein both tools are movable relative to the workpiece during said deformation and/or between deforming steps (on the same workpiece), wherein the axes of rotation of said tools are translated and/or pivoted about an axis.

11. The forming machine according to claim 10, wherein at least one of said tools is able to be pivoted about at least two axes relative to the workpiece during said deformation and/or between deforming steps on the same workpiece, wherein at least two of said axes or projections of each of said axes on a common plane are, at an angle with respect to each other.

12. The forming machine according to claim 11, wherein at least one of said axes is movable during said deformation and/or between deforming steps.

* * * * *